US011214470B2

(12) United States Patent
Smith

(10) Patent No.: US 11,214,470 B2
(45) Date of Patent: Jan. 4, 2022

(54) ROPE MAINTENANCE SYSTEM

(71) Applicants: Maritime Developments Limited, Peterhead (GB); Delmar Systems, Inc., Broussard, LA (US)

(72) Inventor: Derek Smith, Peterhead (GB)

(73) Assignee: Delmar Systems Inc., Broussard, LA (US)

( * ) Notice: Subject to any disclaimer, the term of this patent is extended or adjusted under 35 U.S.C. 154(b) by 227 days.

(21) Appl. No.: 16/250,018

(22) Filed: Jan. 17, 2019

(65) Prior Publication Data

US 2019/0218077 A1 Jul. 18, 2019

(51) Int. Cl.
*B66D 1/50* (2006.01)
*B66C 13/00* (2006.01)
(Continued)

(52) U.S. Cl.
CPC ..... *B66D 1/50* (2013.01); *B65H 59/22* (2013.01); *B66C 13/00* (2013.01); *B66D 1/28* (2013.01);
(Continued)

(58) Field of Classification Search
CPC ..... B66D 2700/0108; B65H 2701/35; B66C 13/10
See application file for complete search history.

(56) References Cited

U.S. PATENT DOCUMENTS 3,338,489 A * 8/1967 Ranson ..... G06K 13/22 226/50
4,979,296 A * 12/1990 Langner ..... D07B 3/00 29/469
(Continued)

FOREIGN PATENT DOCUMENTS

CN 107381394 A 11/2017
JP 1-167200 6/1989
(Continued)

OTHER PUBLICATIONS

Search Report (GB 1800726.0), dated Jul. 12, 2018.

*Primary Examiner* — Emmanuel M Marcelo
(74) *Attorney, Agent, or Firm* — Gregory L. Porter; Hunton Andrews Kurth LLP

(57) ABSTRACT

A method of spooling a crane rope (2) onto a crane drum through a crane rope spooling system (1) from a reel (31) under a predetermined back tension is described and includes the steps of:

unspooling the crane rope (2) from a reel (31) and passing the crane rope through a tensioning system (10) comprising a primary back tensioner (12) and a secondary back tensioner (16);

gripping the crane rope (2) within the secondary back tensioner (16) and thereby preloading the crane rope (2) with tension prior to the crane rope (2) passing through the primary back tensioner (12); and applying a predetermined back tension to the crane rope (2) with the primary back tensioner (12) as the crane rope (2) is being spooled onto the crane drum under the predetermined back tension.

A crane rope spooling system (1) for spooling crane rope (2) onto a crane drum under a predetermined back tension is also described, said system (10) comprising a tensioning system (10) comprising at least a primary back tensioner (12) and a secondary back tensioner (16) and a reel (31).

37 Claims, 13 Drawing Sheets

(51) Int. Cl.

| | |
|---|---|
| ***B66D 1/36*** | (2006.01) |
| ***B65H 59/22*** | (2006.01) |
| ***B66D 1/28*** | (2006.01) |
| ***B66D 1/74*** | (2006.01) |
| ***B66D 3/00*** | (2006.01) |

(52) U.S. Cl.
CPC ..... *B66D 1/36* (2013.01); *B66D 1/505* (2013.01); *B66D 1/741* (2013.01); *B66D 3/006* (2013.01); *B65H 2220/02* (2013.01); *B65H 2701/35* (2013.01)

(56) References Cited

U.S. PATENT DOCUMENTS

| | | | | |
|---|---|---|---|---|
| 2003/0091395 | A1* | 5/2003 | Stockstill | F16L 1/235<br>405/154.1 |
| 2009/0285634 | A1* | 11/2009 | Smith | B29C 48/06<br>405/156 |
| 2011/0274518 | A1* | 11/2011 | Pose | B63B 27/29<br>414/139.4 |
| 2017/0178764 | A1* | 6/2017 | Huang | H01B 5/105 |

FOREIGN PATENT DOCUMENTS

| | | |
|---|---|---|
| JP | 05-270795 | 10/1993 |
| WO | 2014204320 A1 | 12/2014 |

* cited by examiner

ROPE MAINTENANCE SYSTEM

FIELD OF THE INVENTION

This invention relates to a system and method of spooling a rope on to a drum. In particular, the invention relates to a system and method for spooling on crane ropes used on, for example, shipboard cranes and offshore cranes (such as platform, rig and vessel cranes). The invention further relates to a system and method suitable for non-destructive testing of wire ropes.

BACKGROUND OF THE INVENTION

Offshore operators are required to have at least one functional crane on offshore installations at all times. Regular testing of each crane's wire rope is necessary in order to identify corrosion and fatigue that might lead to failure of the rope. At present, crane ropes are inspected annually and tested every 5 years. The ropes are frequently changed out at the same time at significant cost to the operators. Additionally, the time it takes to get the rope off the drum of the crane and inspected or changed out can be substantial, with repeated transpooling operations needed to ensure the rope is correctly tensioned on the crane drum after maintenance or replacement. Depending on the length of the crane's wire rope, completion of the whole process can take days or weeks, increasing the cost to the operator in downtime.

Present testing methods commonly include placing the testing apparatus on the rig or vessel (for example) platform before floating the rig/vessel out to water that is sufficiently deep to permit full extension of the wire rope. A first example of conventional (prior art) testing apparatus P1 is shown schematically in FIG. 1, and consists, from left to right, of a capstan winch C1, a Non-Destructive Testing (NDT) inspection unit (not shown but which would typically be located between the capstan winch C1 and the spooling unit S1), a spooling unit S1, a reel drive system R1 and an initiation winch (not shown), but which would typically be located just under or past the reel drive system R1, to the left of the reel drive system R1 as shown in FIG. 1). The initiation winch is connected to the free end of the rope W1 and initiates the extraction of the rope W1 from the winch or crane (not shown) and particularly from the drum of the winch or crane. The free end of the rope W1 first passes through the capstan winch C1, which turns the rope W1 around an angle of roughly 90° so that the rope W1 can then be fed through the non-destructive testing unit. The rope W1 then passes through the spooling unit S1 which evenly layers the rope W1 onto the drum of the reel drive system R1. The capstan winch C1 is powered and so can create a back tension of, e.g. 10 tonnes-15 tonnes (10,000 kg-15,000 kg) at most. However, this is not sufficient to wind the rope W1 tightly, to the rope manufacturer's recommended tension, back onto the winch/crane drum (not shown) from the drum of the reel drive system R1, once the rope W1 has been tested by the NDT inspection unit.

To solve this problem and to increase the back tension on the rope W1 as it is reeled back onto the winch or crane drum, the platform, vessel, or rig is subsequently floated out into deep water. A weight is connected to the free end of the wire rope W1 and the rope W1 is then payed out to its full extent before being reeled back onto the drum. The resistance of the water column on the weight and moreover the weight of the rope W1 (and the weight itself) can then be exploited as a means of introducing tension into the rope W1 as it is reeled back onto the drum. As the wire rope W1 is tensioned in the water column, the rope W1 stretches, separating the wire fibres and allowing ingress of salt water between the fibres and into the core. As the rope W1 is reeled in, the combination of the application of grease to the outside of the rope W1 and the release of the load on the rope W1 from a combination of extraction from the water column and removal of the weight, thereby returning the fibres to their original configuration, acts to trap the salt water between the fibres of the rope W1. This increases the risk of corrosion and failure of the rope W1. As even brand new ropes undergo this process to ensure they are safe, the overall lifetime of the rope W1 is actually reduced. In addition, the cost and time required to perform this operation is substantial.

A disadvantage of using capstan winch C1 is that the drum of the capstan winch C1 is flat and therefore as rope W1 is laid onto the winch, the lower layers get crushed under the weight and tension of the subsequent layers. For wire ropes W1, this can lead to breakage of the wires making up the wire rope W1, weakening the rope W1 and risking potential failure of the rope W1 under load. Crushing of the rope W1 will be detected during non-destructive testing of the rope W1 and the rope W1 will require changing out.

Some wire rope testing methods involve severing a length of the wire rope W1 before testing the rope W1. Frequently, the length is cut from the free end of the rope W1 for simplicity. However as this is one of the most exposed and heavily-used portion of the rope W1, this can lead to premature condemnation of the rope W1, resulting in complete replacement of the rope W1 again at significant cost to the operators. Alternatively, as it is a small section of the rope W1 that is being examined, there may be other sections that are in fact weaker than the severed length. In particular, parts of the rope W1 that are exposed to rotation e.g. over sheaves are often weakened more than other parts.

A second example of a conventional (prior art) testing system P2 for testing crane ropes W2 is shown in FIG. 2 and comprises, from right to left, a sheave A2, a 4-track tensioner apparatus T2, a NDT inspection unit (not shown), a spooling unit S2, a reel drive system R2 and an initiation winch (not shown). As described above for the first system P1, the initiation winch is connected to the free end of the crane rope W2 and initiates the extraction of the rope W2 from the crane. Sheave A2 acts to change the direction of the wire rope W2 as it is pulled from the crane and through the 4-track tensioner T2, before passing through the NDT inspection unit and then through the spooling unit S2 and being laid on the drum of a reel drive system R2. Although the tensioner T2 provides some back tension when the rope W2 is returned to the crane (in the region of 10 t-15 t or 10,000 kg-15,000 kg), it is again not sufficient tension to return the rope W2 tightly to the drum of the crane and some slack remains. This is partly due to the tensioner T2 struggling to grip the greased rope W2, resulting in the rope W2 being more prone to sliding within the tensioner T2.

SUMMARY OF THE INVENTION

According to the invention, there is provided a method of spooling a crane rope onto a crane drum through a crane rope spooling system from a reel under a predetermined back tension, said method including the steps of:—

- unspooling the crane rope from a reel and passing the crane rope through a tensioning system comprising a primary back tensioner and a secondary back tensioner;
- gripping the crane rope within the secondary back tensioner and thereby preloading the crane rope with tension prior to the crane rope passing through the primary back tensioner; and applying the predetermined back tension to the crane rope with the primary back tensioner as the crane rope is being spooled onto the crane drum under the predetermined back tension.

Optionally the tensioning system applies a predetermined back tension to the rope in the region of 20 t-100 t (20,000 kg-100,000 kg), optionally 40 t-80 t (40,000 kg-80,000 kg), in accordance with the rope manufacturer's recommended specifications. Optionally the method includes monitoring and logging the back tension on the rope at all times as it is spooled onto to the crane drum preferably to assess the laying-on of the crane rope onto the crane drum. This provides confirmation that the rope is being laid onto the crane drum tightly in accordance with the rope manufacturer's specifications.

Optionally the method includes passing the rope through a greasing unit and applying grease to the rope as it is spooled onto the crane drum.

The method may further include configuring the primary back tensioner and the secondary back tensioner to provide resistance against the pulling force of the crane drum, and thereby maintain a defined load on the crane rope as it is spooled onto the crane drum.

Optionally the secondary back tensioner grips the rope by compression, for example between the two tracks of the tensioner if a 2-track tensioner is being used. Optionally the gripping of the rope by the secondary back tensioner leads to a frictional contact between the outer surface of the rope and the surfaces of the secondary back tensioner.

Optionally the primary back tensioner provides the system with a means, for example a point, against which the rope may be pulled taut. Preferably, the primary back tensioner provides the system with a means, for example at least one drum and preferably two drums, around which the rope may be wound such that it may then be pulled taut against, such that the rope transitions around the primary back tensioner through at least 360° and preferably is wound around the at least one drum and more preferably around the twin drums a plurality of times (i.e. a multiple of 360°).

Optionally the primary and the secondary back tensioners are driven by at least one motor, optionally at least one motor on each of the primary and secondary back tensioners. Optionally, where the primary tensioner is a twin-drum traction winch, one motor drives both drums.

Optionally the method includes applying sufficient force with the secondary back tensioner to keep the rope taut as it is fed into the primary back tensioner from the secondary back tensioner. Optionally the secondary back tensioner applies a force within the range of 1 t-12 t (1,000 kg-12,000 kg), optionally 1 t-6 t (1,000 kg-6,000 kg), more preferably around 2 t-5 t (2,000 kg-5,000 kg). Optionally the method includes tensioning the rope using the secondary back tensioner to keep the rope taut between the tensioning system, optionally between the tensioning system and a sheave assembly, optionally between the tensioning system and the crane drum.

Optionally the crane rope spooling system may also be used to remove a crane rope from a crane drum. Optionally the same crane rope may then be spooled back onto the crane drum. Alternatively, a different crane rope is spooled onto the crane drum, for example a new crane rope where damage has been detected in the original crane rope. Accordingly, in such embodiments, the method may include the prior steps of unspooling the crane rope from the crane drum, passing the crane rope through the crane rope maintenance system, and spooling the crane rope onto a reel drum within a reel drive system.

Optionally, the method includes pulling the crane rope into the crane rope spooling system by reeling the cable back around the initiation winch and thereby guiding the crane rope into the crane rope maintenance system.

Optionally the crane rope is a wire rope. Optionally the rope is manufactured from steel.

Optionally the method includes lowering the rope and removing the crane hook or other rope terminator, if required. Optionally the method includes connection of the free end of the rope which is typically the rope termination, for example a spelter socket, to an initiation winch.

Optionally the initiation winch is located adjacent to a reel drive system. Optionally the reel is within the reel drive system. Optionally the initiation winch is integral to the reel drive system. Optionally after connection of the rope to the initiation winch, the rope is extracted such that it passes through the rope maintenance system.

Optionally the initiation winch comprises a cable, optionally a polyester cable, which can be attached to the rope termination before being wound back onto the initiation winch, thereby guiding the rope into the maintenance system. Typically, the initiation winch is further arranged such that when the crane rope is to be removed from a crane drum and passed through the crane rope maintenance system, the winch cable is connected to the free end of the crane rope, the initiation winch is turned, and the initiation winch cable is reeled back onto the initiation winch drum; and wherein as the initiation winch cable is reeled in, the crane rope is extracted from the crane drum and pulled into the crane rope maintenance system.

Optionally the method includes compensating for heave of a vessel upon which the crane rope spooling system is located, optionally using a passive heave compensation system. Optionally the heave compensation system forms part of a sheave assembly. Optionally the heave compensation system comprises a movable wheel within the sheave assembly, which can move in response to movements of the vessel and optionally thereby keep the rope from going slack or too tight, keep the rope in contact with the movable wheel and reduce the risk of loose rope being fed into the tensioning system, or the rope slipping off the wheel entirely. Optionally the method includes weighting down the sheave assembly to prevent lifting of the assembly as the rope returns to the crane under back tension of around 20 t-100 t (20,000 kg-100,000 kg), optionally 60 t-80 t (60,000 kg-80,000 kg). Optionally the weights are calibrated and can be used for load testing rope if required.

Positioning the system on the deck of a sea- or ocean-going vessel is particularly advantageous as it allows the system to be used in several different locations. Optionally the vessel may carry multiple reels of new rope and visit several offshore locations in a single campaign, offering the option of changing out several ropes that may have been identified as defective or damaged during the same trip without requiring a return to port. Additionally, as the apparatus is on the back of a sea- or ocean-going vessel and not located on e.g. a rig floor, space is conserved on the already tightly-packed rig. The system further then does not have to be ATEX rated.

Alternatively, the method includes locating the crane rope spooling system on a quayside. When the system is located on a quayside, no heave compensation system is then necessary, and a standard sheave assembly may be used, i.e. without requiring heave compensation. Alternatively, if it is present, the heave compensation system may be locked in one position for quayside use without requiring any changing of the sheave assembly.

Optionally the method includes tensioning the rope as it is removed from the crane, for example shipboard crane, or offshore crane (such as platform, rig and vessel cranes). Optionally a constant tension is applied to the rope after it has been pulled into the crane rope spooling system by the initiation winch. Optionally the method includes applying force to the rope using the tensioning system and optionally thereby tensioning the rope.

Optionally the method includes passing the rope through the primary back tensioner, optionally a traction winch, optionally a 2-drum traction winch and the secondary back tensioner, optionally a tensioner, optionally a 2-track tensioner, or alternatively optionally a 4-track tensioner. Optionally the method includes gripping the rope within the tensioning system to apply tensioning force.

Optionally the method includes gripping the rope within the secondary back tensioner and thereby optionally providing back tension on the rope relative to the primary back tensioner as the rope is being spooled onto the reel within the reel drive system.

Optionally both the primary and secondary back tensioners are braked, that is, the secondary back tensioner optionally provides resistance against the pulling force of the initiation winch and subsequently against the motor of the reel drive system, optionally to prevent the rope moving freely and to thereby optionally impart increased tension to the rope and optionally to thereby maintain the tautness of the crane rope.

Optionally the method includes applying sufficient force with the secondary back tensioner to keep the rope taut as it is fed into the secondary back tensioner from the primary back tensioner. Optionally the method includes preloading the rope with tension as it passes through the secondary back tensioner to enhance the primary back tensioner's grip on the rope. Optionally the method includes tensioning the rope using the secondary back tensioner to keep the rope taut between the primary back tensioner and the reel within the reel drive system. Also optionally, the method includes preloading the crane rope with tension applied by the secondary back tensioner as the crane rope is spooled onto the reel within the reel drive system.

Optionally the method includes testing the rope after it passes through the tensioning system, optionally before transpooling of the rope onto the reel of the reel drive system. Optionally the testing of the rope is non-destructive, for example using electromagnetic testing devices, but any suitable non-destructive testing method may be used. Optionally the method includes rendering the data gathered by the testing unit and optionally analysing the rendered data.

Optionally the method includes passing the rope through at least one spooling unit. Optionally the spooling unit is positioned before the reel drive system, so that optionally the rope passes through the spooling unit before it is transpooled onto the reel drum within the reel drive system. Optionally the spooling unit moves laterally, optionally to improve the evenness of the laying on of the rope onto the reel drum.

Optionally the method includes applying back tension to the rope as it is laid onto the reel drum of the reel drive system. Optionally the secondary back tensioner preloads the rope with tension as it is spooled onto the reel drum of the reel drive system. Optionally the secondary back tensioner preloads the rope with 1 t-12 t (1,000 kg-12,000 kg), preferably around 2 t-5 t (2,000 kg-5,000 kg) of tension as it is spooled onto the reel drum of the reel drive system.

Optionally the method includes returning the tested rope to the crane drum after testing is completed. Optionally the rope is returned under a predetermined tension according to the rope manufacturer's recommended specifications. The crane drum is driven by a motor, to rotate the crane drum and pull the crane rope back through the crane rope spooling system and onto the crane drum.

Optionally the method includes changing out the rope in response to detection of a defect during testing of the rope, where the old rope is then replaced with new rope. Optionally the reels of the reel drive system are each on pallets and thus can be easily lifted and moved. Optionally the reel drive system comprises parallel rails, or similar tracks, between which the reels are located. Optionally the reel drive system further includes towers adapted to connect a reel to the reel drive system. Optionally the towers are connected to the reel that is receiving the rope during testing, optionally on either side of the reel and optionally the towers are mounted onto the rails. Typically, the method further includes connecting at least one reel to the reel drive system. Optionally, the method further comprises mounting the reel drive system on tracks along which the reel drive system is configured to skid; disconnecting the reel drive system from the reel when the reel is no longer required; skidding the reel drive system between reels; and reconnecting the reel drive system to the new reel to be utilised.

Optionally the reels are arranged linearly, e.g. one reel behind the other. Optionally the pallets are positioned on platforms. Optionally, moving in a direction away from the rope maintenance system, each platform reduces in height. Having the platforms reducing in height offers the advantage that when a rope is to be replaced, the new rope may more easily be fed underneath the reel or reels that are disposed between the reel holding the new rope to be spooled onto the crane and the crane rope maintenance system.

Optionally where the rope is being changed out, the method includes completely removing the rope from the crane to leave an empty drum ready to receive a new rope on the crane. Optionally the method includes moving towers along the rails to a reel holding new rope and optionally connecting the reel drive system to the new reel. Optionally the new reel is connected to the reel drive system via the towers through the central axis of the reel. Optionally the towers comprise lifting apparatus that lifts the reel after connection through the central axis of the reel, thereby permitting rotation of the reel. Optionally the rope is then reconnected to the crane drum for replacement.

Optionally the reel that now holds the old rope can be moved from the reel drive system to another location for scrappage or other processing activities at a later stage, e.g. once the vessel has returned to port.

Optionally the new rope is loaded for additional back tension during its spooling on to the crane drum.

According to the present invention, there is provided a crane rope spooling system for spooling crane rope onto a crane drum under a predetermined back tension, said system comprising a tensioning system comprising at least a primary back tensioner and a secondary back tensioner and a reel.

Optionally as the crane rope is being spooled on to a crane drum, the secondary back tensioner preloads the crane rope and allows the primary back tensioner to generate a predetermined tension on the crane rope. Optionally the crane rope spooling system comprises monitoring and/or logging means, optionally configured to monitor and optionally log the tension on the crane rope at all times as the crane rope is being spooled on to the crane drum.

Optionally, as the crane rope is being spooled on to the crane drum, the secondary back tensioner preloads the rope and allows the primary back tensioner to generate tension on the rope. The primary back tensioner preloads the rope with a force within the range of 20 t-100 t (20,000 kg-100,000 kg), optionally 40 t-80 t (40,000 kg-80,000 kg).

Preloading the rope with tension is particularly useful when the ropes are coated in grease, as there is a risk of slippage of the rope as it passes through the tensioning system in either direction, which may result in slack on the line or, potentially, damage to the rope.

Adjacent to the secondary back tensioner there can be a wire guide for keeping the rope at the correct level and angle prior to feeding the rope into the secondary back tensioner when the rope is being returned to the crane.

Optionally the secondary back tensioner is a 2-track tensioner, alternatively optionally the secondary back tensioner is a 4-track tensioner.

Optionally the crane rope is spooled on to and preferably around the primary back tensioner. Optionally the primary back tensioner may be a traction winch. Optionally where the primary back tensioner is a traction winch, the traction winch may optionally comprise two drums around which the rope is spooled. Optionally the drums are powered by a motor. Optionally the secondary back tensioner is powered by a further motor, optionally two motors. An advantage of a traction winch with twin drums is that the drums act to multiply the tension and force on the rope in a similar fashion to a pulley sheave system.

Optionally the traction winch drums are grooved. Optionally the grooves on the first drum are offset from the grooves on the second drum, such that optionally the rope is wound around the twin drum at an angle relative to the mutual axis of the drums. Optionally the grooves are formed on an interchangeable surface of the drums.

Optionally different surfaces can be installed on the drum with different sizes of grooves to accommodate different diameters of ropes, for example one surface may comprise grooves that can accommodate rope with diameter 100-104 mm and another may accommodate a rope with diameter 120-125 mm. The ability to test and change out a variety of ropes with different diameters allows the same system to be used for many different lifting and/or handling apparatuses. By way of example, the system may be used to test cranes on oil rigs, pipe laying vessels and/or FPSOs, all of which may have very different tonnage ratings, lifting capacities and rope diameters. A further advantage of having grooved surfaces on the traction winch is that it reduces crushing of the rope which may distort and weaken the fibres. As damage to the rope is reduced, or avoided, the same rope can be safely reused after the testing and maintenance process has been completed.

Optionally the crane ropes are wire ropes, optionally steel wire ropes.

Optionally the crane rope spooling system is positioned on the deck of a vessel. Alternatively, the crane rope spooling system is positioned on a quayside or similar onshore location. Optionally the crane rope spooling system tests rope used with cranes, for example shipboard cranes and offshore cranes (such as platform, rig and vessel cranes).

Optionally the crane rope spooling system includes an initiation winch located adjacent to a reel drive system. Optionally the initiation winch is integral to the reel drive system. Optionally the initiation winch comprises cable, optionally made of polyester or similar material. An advantage of using polyester cable is that it offers a weight saving over, e.g. steel.

Optionally the initiation winch cable is connected to the free end of the rope, optionally the termination of the rope, for example a spelter socket or similar termination. Optionally when the rope is to be reeled out and through the crane rope maintenance system, the initiation winch is turned, optionally driven by a motor and the initiation winch cable is reeled back onto the initiation winch drum. Optionally as the initiation winch cable is reeled in, the rope is extracted from the crane and pulled into the crane rope maintenance system.

Optionally when the crane rope is being removed and passed through the crane rope maintenance system, the rope first passes through a sheave assembly. Optionally when the crane rope is being spooled onto the crane drum, the rope passes through the sheave assembly as one of the last steps of the process. The sheave assembly acts to turn the rope so that it is being spooled on/off the crane drum at an optimal angle to minimise e.g. damage to the rope. Optionally the sheave assembly may comprise a heave compensation mechanism. Optionally the heave compensation mechanism comprises a movable wheel, for example vertically movable, in response to heave experienced by a vessel. Optionally the sheave assembly is weighted down, optionally to prevent lifting of the sheave assembly in response to the back tension on the rope as it returns to the crane under back tension of around 20 t-100 t (20,000 kg-100,000 kg), optionally 40 t-80 t (40,000 kg-80,000 kg). Optionally the sheave assembly is weighted with calibrated weights.

Alternatively, if the crane rope spooling system is positioned onshore, the sheave assembly may be fixed in position so that the wheel can rotate but not otherwise move. The wheel then ensures that the rope is entering the tensioning system at the correct angle.

Optionally after the rope passes through the sheave assembly, the rope may then be passed through a grease injector. The grease injector may optionally apply grease to the rope after the testing process is complete, while the rope is returning to the crane. The grease can act to lubricate the rope and protect the rope from both frictional damage and environmental damage.

Optionally after the rope has passed through the sheave assembly and optionally after the rope has passed through the grease injector, it is wound around the primary back tensioner.

Preferably, the crane rope spooling system further comprises a non-destructive testing unit for testing the crane rope as it is being removed from a crane drum by passing the crane rope through the non-destructive testing unit. Optionally the rope passes through a separate non-destructive testing (NDT) system, optionally disposed between the tensioning system and the reel drive system. Optionally the NDT system is contained within the tensioning system. Optionally the NDT system is disposed between the primary back tensioner and the secondary back tensioner. Optionally the rope is tested as it is being extracted from the drum of the crane. An advantage of positioning the NDT between the primary back tensioner and the secondary back tensioner is that the rope is held in tension at this point, and defects are more easily identified due to movement of the rope being minimised.

After the rope passes through the primary back tensioner and optionally after the NDT system, the rope then passes through the secondary back tensioner. The secondary back tensioner keeps the rope taut as it is being removed from the crane so that the rope is tightly laid onto the drum of the reel within the reel drive system. Preloading the rope with tension using the primary back tensioner enhances the grip that the secondary back tensioner can get on the rope as it feeds through the secondary back tensioner.

Optionally the wire guide may be used to keep the rope at the correct level and angle prior to feeding into a spooling unit, when the rope is being removed from the crane and spooled onto the reel drum within the reel drive system.

Optionally the secondary back tensioner preloads the rope with tension as it is spooled onto the reel drum within the reel drive system. Optionally the secondary back tensioner preloads the rope with 1 t-12 t (1,000 kg-12,000 kg), 1 t-6 t (1,000 kg-6,000 kg), preferably around 2 t-5 t (2,000 kg-5,000 kg) of tension as it is spooled onto the reel.

When the rope is being removed from the crane and after the rope has passed through the tensioning system, it may then optionally pass through a spooling unit. The spooling unit may optionally be positioned immediately adjacent to the reel drive system. Optionally the spooling unit moves laterally as the rope is spooled onto the reel, laying the rope evenly across the drum of the reel.

Optionally the reel drive system comprises a first empty reel, onto which the rope undergoing testing may be spooled. Optionally the reel drive system further comprises at least a second reel with a new rope spooled onto it, optionally positioned behind the first empty reel relative to the rope maintenance system. Where the rope undergoing testing is identified as requiring changing out, the new rope from the second reel may be used to replace the old rope that has undergone testing and requires changing out.

Optionally the reel drive system may comprise rails or bearings or similar tracks that allow sliding movement of the towers that connect to the active reel. Optionally the reel drive system comprises parallel rails or similar tracks, between which the reels are located.

Optionally the reels of the reel drive system are each on pallets. Optionally the pallets may be on platforms and optionally the platforms reduce in height the further they are from the rope maintenance system. Optionally the reels can be lifted and repositioned by a crane on the vessel or optionally by a crane in the onshore location, for example once the vessel has returned to port. Optionally the reel drive system is configured to slide or skid along the rails or tracks. Optionally the reel drive system is connected to the reel that is receiving the rope during testing, i.e. the active reel, where the active reel is the reel on which rope currently in use is spooled. Optionally the towers are connected to the reel at opposite sides of the reel and optionally through the central axis of the reel.

Optionally where the rope is being changed out, the method includes completely removing the rope from the crane drum to leave an empty drum on the crane ready to receive a new rope. Optionally, the crane rope spooling system is therefore further suitable for removing a crane rope from a crane drum and passing the crane rope through the crane maintenance system. Optionally, the crane rope spooling system is further capable of being used wherein as the crane rope is being reeled off a crane drum, the crane rope passes through the primary back tensioner prior to passing through the secondary back tensioner; and wherein the crane rope is preloaded with tension by the primary back tensioner before it enters the secondary back tensioner, thereby enhancing the grip of the secondary back tensioner on the crane rope as it feeds through the secondary back tensioner. Optionally once the rope has been fully spooled onto the reel of the reel drive system, the towers on the reel drive system can be slid along the rails or tracks to a reel holding new rope and are then connected to the new reel. Optionally the towers comprise lifting apparatus and once the towers are connected to the reel holding the new rope, the reel is lifted by the lifting apparatus, thereby permitting rotation of the reel.

The above described method and system offers the advantage that regular inspection of crane ropes can be performed more quickly and therefore made more cost-effective. The method and system also tests the complete length of the rope. Testing of the ropes may be performed more regularly and without requiring paying out of the vast majority of the entire length of the rope into the sea or ocean water column. For example, annual inspections of ropes can highlight possible areas of the rope requiring more intensive checks and testing the following year to investigate whether the rope is at the point of requiring replacement. The annual checks would offer up to date logs and traceability of rope condition over time.

The various aspects of the present invention can be practiced alone or in combination with one or more of the other aspects, as will be appreciated by those skilled in the relevant arts. The various aspects of the invention can optionally be provided in combination with one or more of the optional features of the other aspects of the invention. Also, optional features described in relation to one aspect can typically be combined alone or together with other features in different aspects of the invention. Any subject matter described in this specification can be combined with any other subject matter in the specification to form a novel combination.

Various aspects of the invention will now be described in detail with reference to the accompanying figures. Still other aspects, features and advantages of the present invention are readily apparent from the entire description thereof, including the figures, which illustrates a number of exemplary aspects and implementations. The invention is also capable of other and different examples and aspects, and its several details can be modified in various respects, all without departing from the scope of the present invention as defined by the claims. Accordingly, each example herein should be understood to have broad application and is meant to illustrate one possible way of carrying out the invention, without intending to suggest that the scope of this disclosure, including the claims, is limited to that example. Furthermore, the terminology and phraseology used herein is solely used for descriptive purposes and should not be construed as limiting in scope. Language such as "including", "comprising", "having", "containing" or "involving" and variations thereof, is intended to be broad and encompass the subject matter listed thereafter, equivalents and additional subject matter not recited and is not intended to exclude other additives, components, integers or steps. Likewise, the term "comprising" is considered synonymous with the terms "including" or "containing" for applicable legal purposes. Thus, throughout the specification and claims unless the context requires otherwise, the word "comprise" or variations thereof such as "comprises" or "comprising" will be understood to imply the inclusion of a stated integer or group of integers but not the exclusion of any other integer or group of integers.

Any discussion of documents, acts, materials, devices, articles and the like is included in the specification solely for the purpose of providing a context for the present invention. It is not suggested or represented that any or all of these matters formed part of the prior art base or were common general knowledge in the field relevant to the present invention.

In this disclosure, whenever a composition, an element or a group of elements is preceded with the transitional phrase "comprising", it is understood that we also contemplate the same composition, element or group of elements with transitional phrases "consisting essentially of", "consisting", "selected from the group of consisting of", "including" or "is" preceding the recitation of the composition, element or group of elements and vice versa. In this disclosure, the words "typically" or "optionally" are to be understood as being intended to indicate optional or non-essential features of the invention which are present in certain examples but which can be omitted in others without departing from the scope of the invention.

All numerical values in this disclosure are understood as being modified by "about". All singular forms of elements or any other components described herein are understood to include plural forms thereof and vice versa. References to directional and positional descriptions such as upper and lower and directions e.g. "up", "down" etc. are to be interpreted by a skilled reader in the context of the examples described to refer to the orientation of features shown in the drawings and are not to be interpreted as limiting the invention to the literal interpretation of the term, but instead should be as understood by the skilled addressee.

BRIEF DESCRIPTION OF THE FIGURES

In the accompanying drawings:

FIG. 2 shows a second example of a conventional (prior art) wire rope testing system with a sheave, 4-track tensioner and reel drive system. Embodiments of the present invention will now be described, by way of example only, with reference to the accompanying drawings, in which:

DETAILED DESCRIPTION OF EXAMPLES OF THE INVENTION

Figure 1:
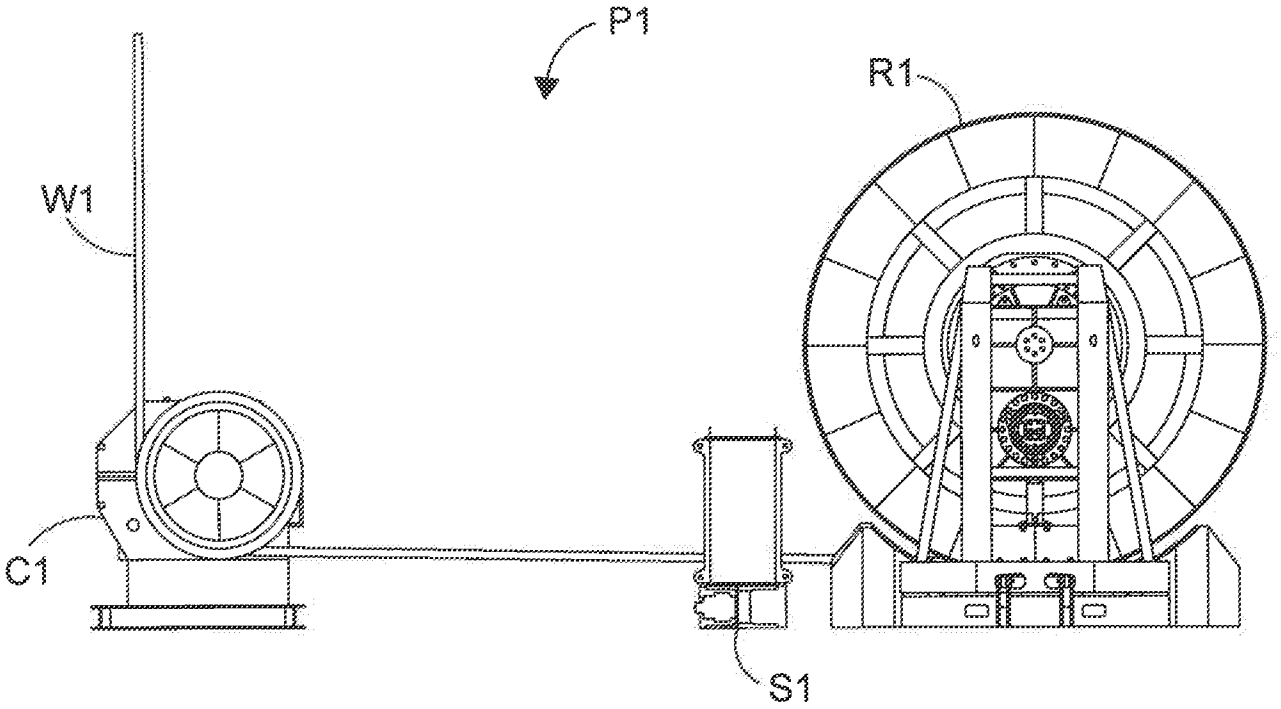
PRIOR ART FIG. 1
FIG. 1 shows a first example of a conventional (prior art) wire rope testing system with a capstan winch and reel drive system.
Figure 2:
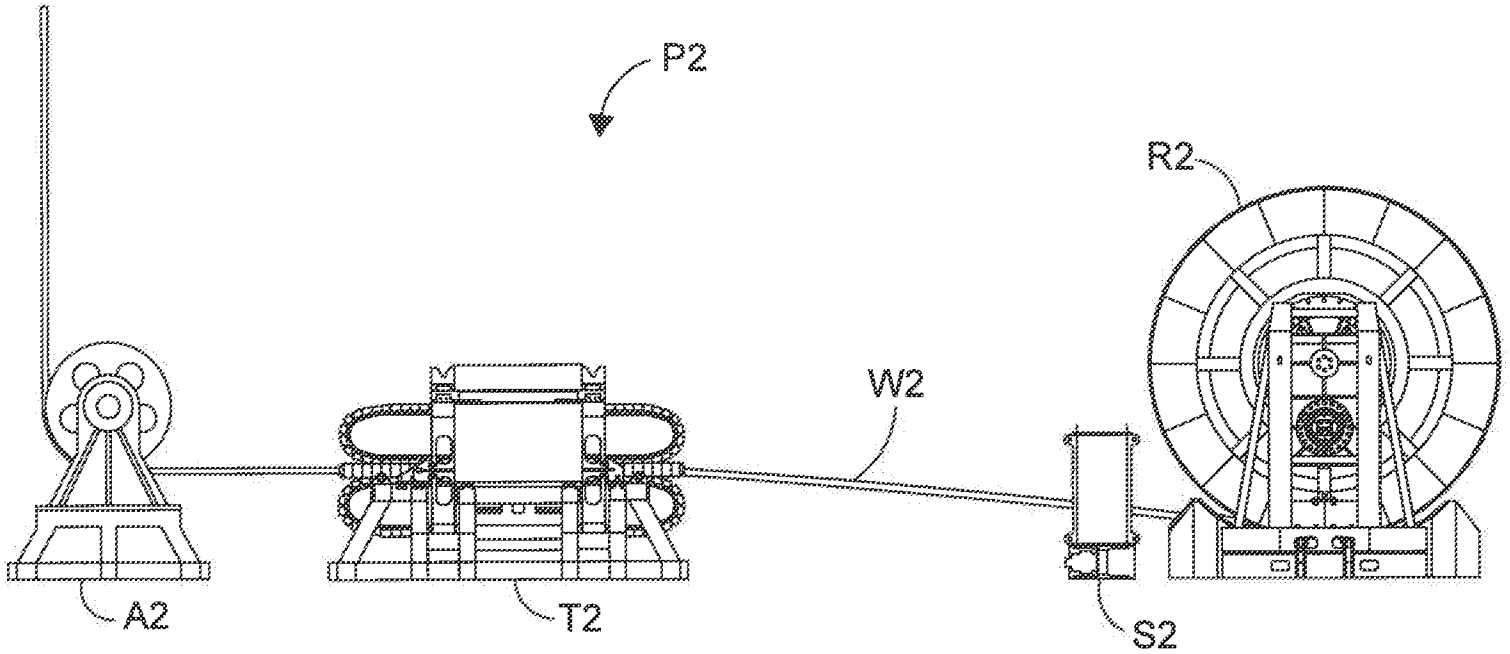
PRIOR ART FIG. 2
Figure 3:
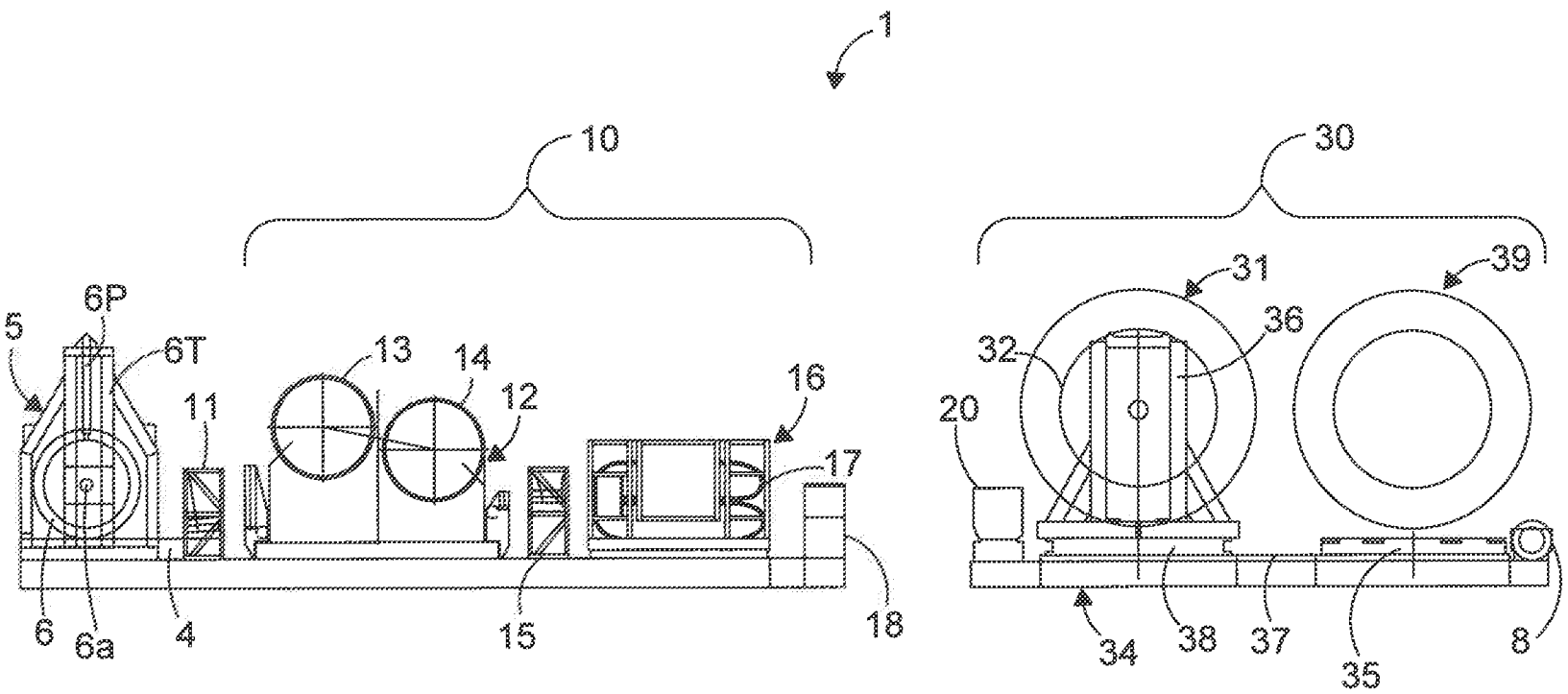
FIG. 3 shows a side view of an embodiment of a crane rope spooling system in accordance with the present invention, where the crane rope is to be removed from the crane, prior to any rope entering the system, as comprising (from left to right) a heave compensation sheave assembly, a grease injector, a traction winch, an NDT unit, a tensioning system, a wire guide, a spooling unit, a reel drive system and an initiation winch.

Referring now to the drawings, FIG. 3 shows an example of a crane rope spooling system 1 for spooling crane ropes on to a crane drum (not shown). The system 1 as shown in FIG. 3 comprises, from left to right: a sheave assembly 5 including a heave compensation system 6*hc;* a grease injector 11; a tensioning system 10 comprising at least a primary back tensioner, in this example a twin-drum traction winch 12 and a secondary back tensioner, in this example a 2-track tensioner 16 and a Non-Destructive Testing (NDT) inspection unit 15 located between the traction winch 12 and the tensioner 16; a wire guide 18; a spooling unit 20 and a reel drive system 30 which comprises at least one reel 31 and more preferably at least one spare reel 39 such that the reel drive system 30 preferably comprises at least two reels 31, 39 and an initiation winch 8.

Optionally the ropes to be maintained are wire ropes, optionally steel wire ropes typically used on cranes (not shown), for example shipboard cranes or offshore cranes (such as platform, rig, and vessel cranes).

The crane rope spooling system 1 is suitable for positioning on the back deck of a sea- or ocean-going vessel (not shown) such as an Offshore Supply Vessel (OSV) (not shown) or Platform Supply Vessel (PSV) (not shown), which can then travel around visiting e.g. oil and gas platforms, rigs, FPSOs and the like (not shown) which have a crane (not shown) whose rope 2 requires to be serviced, inspected, maintained or replaced. The system 1 is sufficiently compact that there is room on the deck of the vessel for several spare reels of new rope, offering the option of changing out multiple defective or damaged ropes during a single trip. Using the back deck of such a vessel as the work space for the system 1 also saves space on the rigs, platforms, FPSOs etc. where space can be extremely limited.

Alternatively, the crane rope spooling system 1 is positioned on a quayside (not shown) or similar onshore location (not shown) and can be used to maintain crane ropes on a vessel (not shown) such as a platform or rig that has a crane (not shown) whose rope requires to be serviced, inspected, maintained or changed out in port (not shown), or can even be used in relation to wholly onshore or land-based cranes (not shown).

As can be seen in FIG. 3, the initiation winch 8 is located immediately adjacent to the reel drive system 30 and is integral with it. To save weight, the initiation winch 8 can comprise a cable 7 made from lightweight materials such as polyester or similar. The cable 7 is sufficiently strong to pull the crane rope 2 into the crane rope spooling system 1 without fraying or breaking.

Figure 4:
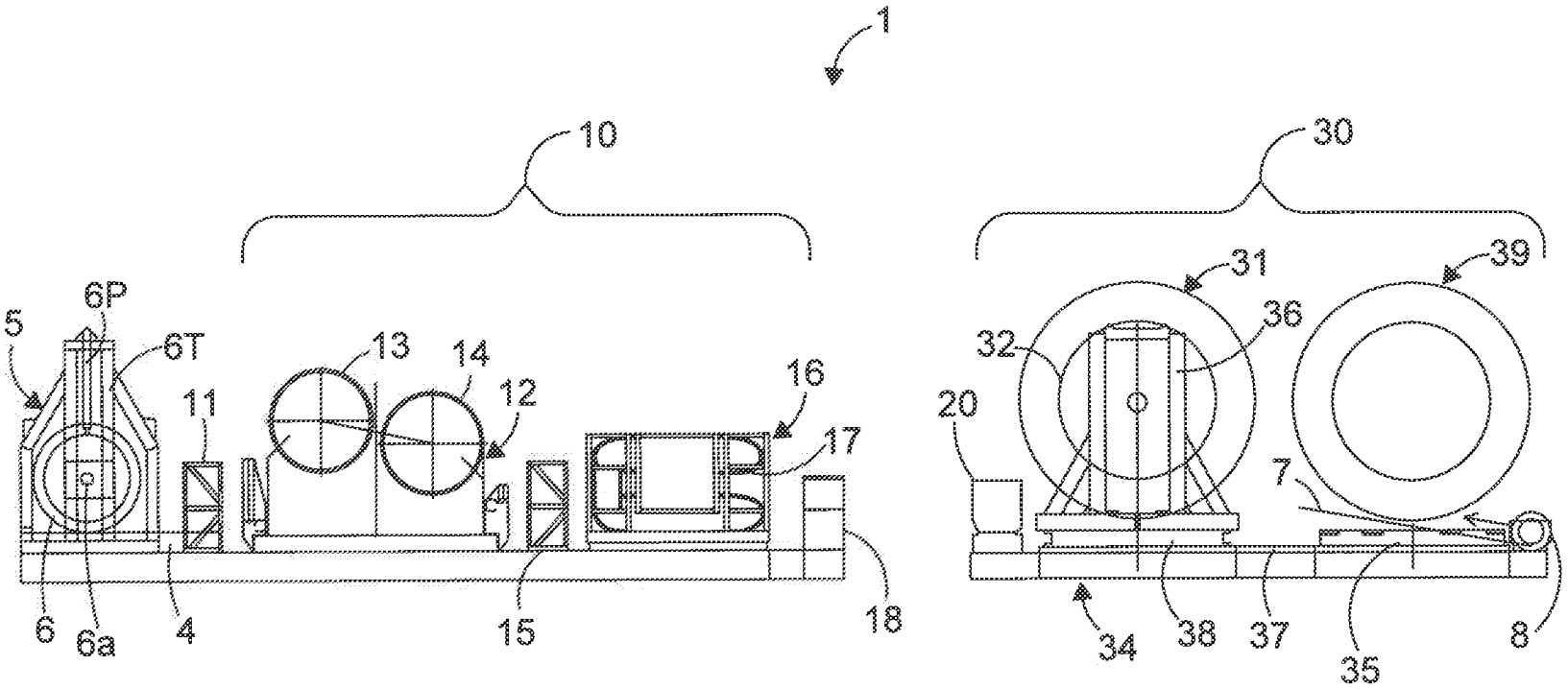
FIG. 4 shows the crane rope spooling system of FIG. 3 at the start of the method in accordance with the present invention, with the cable of the initiation winch being pulled out for connection to the free end of the crane rope (not shown in FIG. 4)
Figure 5:
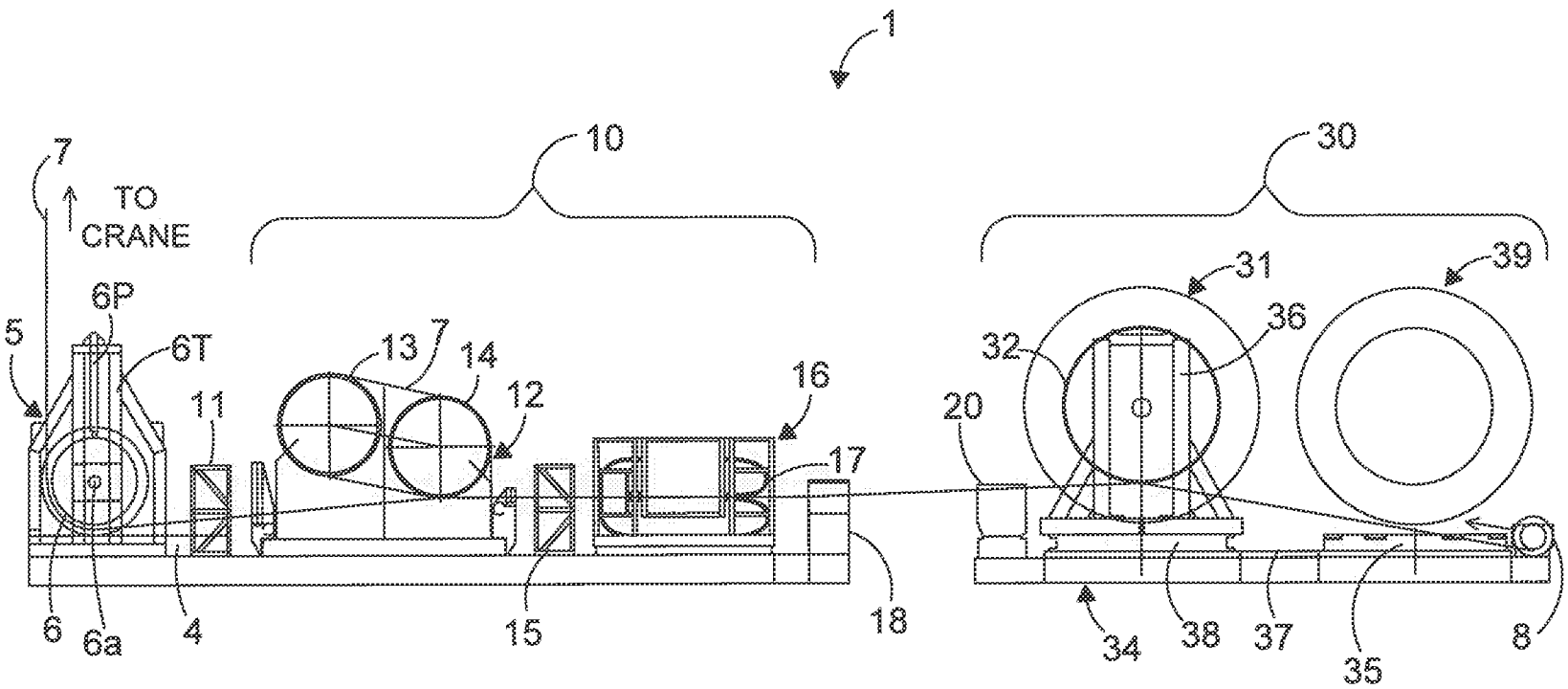
FIG. 5 shows the crane rope spooling system of FIG. 3 showing the next stage of the method on from the stage shown in FIG. 4, with the cable of the initiation winch having been fully extended through the system towards the free end (not shown in FIG. 5) of the crane rope.

FIGS. 4-5 show the cable 7 of the initiation winch 8 being reeled out to connect to the free end of the crane rope 2 which is to be removed from the crane drum for testing before the same or a new crane rope 2 is then spooled onto the crane drum.

Figure 6:
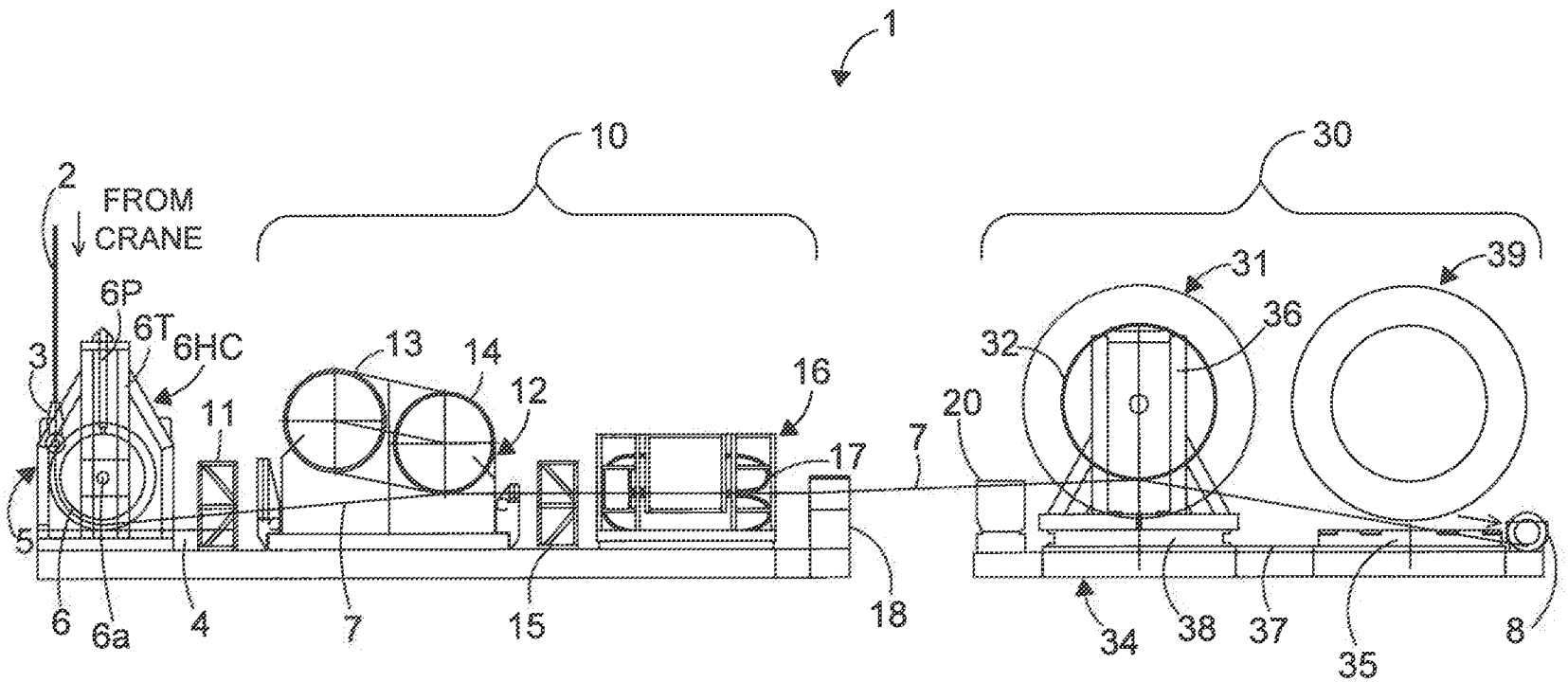
FIG. 6 shows the crane rope spooling system of FIG. 3 showing the next stage of the method on from the stage shown in FIG. 5, with the free end of the crane rope being guided into the sheave assembly.

The crane hook (not shown) is firstly removed from the free end of the rope 2, if required. The initiation winch cable 7 is then connected to the free end of the crane rope 2, in this example terminated by a spelter socket 3. The initiation winch 8 pays in and the cable 7 is reeled back onto the drum of the initiation winch 8, reeling out the crane rope 2 from the crane drum (not shown) and into the crane rope spooling system 1, as seen in FIG. 6. As the initiation winch 8 is reeling the rope 2 into the crane rope spooling system 1, the motor applies a constant tension to the rope 2 through the cable 7.

The rope 2 first passes through the sheave assembly 5, which in this example includes a passive heave compensation system 6*hc* comprising a movable wheel 6. The wheel 6 can move vertically to compensate for heave of the marine vessel (not shown) on which the crane rope spooling system 1 is located and secured to. In this way, the rope 2 is kept taut and in contact with the wheel 6 at all times, and the rope 2 is prevented from going slack or too tight. To achieve this, the wheel 6 is connected through its central axis to a bracket 6*a* on either side of the wheel 6. Each bracket 6*a* is retained within vertical guides 6*t* so that the wheel 6 may rotate around its axis and move vertically, but is restricted from lateral movement. The vertical movement of the wheel 6 is itself restrained by cylinders 6*p* which are connected to at least one of and more preferably both of the brackets 6*a* or a similar resilient device that acts to dampen the vertical motion of the wheel 6. The cylinders 6*p* provide the main element of the heave compensation system 6*hc* and thereby prevent damage to the rope 2, the vessel or the system with increased loading, or the components of the sheave assembly 5, through sudden movement caused by e.g. waves hitting the vessel on which the system 1 is located. The heave compensation system 6*hc* further reduces the power requirements of the crane rope spooling system 1 as the heave compensation system 6*hc* maintains a constant tension between the traction winch 12 and the crane, by compensating for the heave of the vessel and thereby removing the necessity to alter the speed of either removal of the rope 2 from the crane or return of the rope 2 to the crane.

If the crane rope spooling system 1 is positioned in an onshore location, the sheave assembly 5 may be locked in position so that the wheel 6 can rotate but not otherwise move and thus the heave compensation system 6*hc* is deactivated or disabled. The wheel 6 then ensures that the rope 2 is entering the tensioning system 10 at the correct angle. The sheave assembly 5 can thus either comprise a heave compensation system 6*hc* at all times and the operator can merely lock the brackets 6*a* in place on the tracks 6*t* if no heave compensation is required, or the sheave assembly 5 may be changed out for a standard sheave assembly (not shown) with no capacity for vertical movement of the wheel 6.

Figure 7:
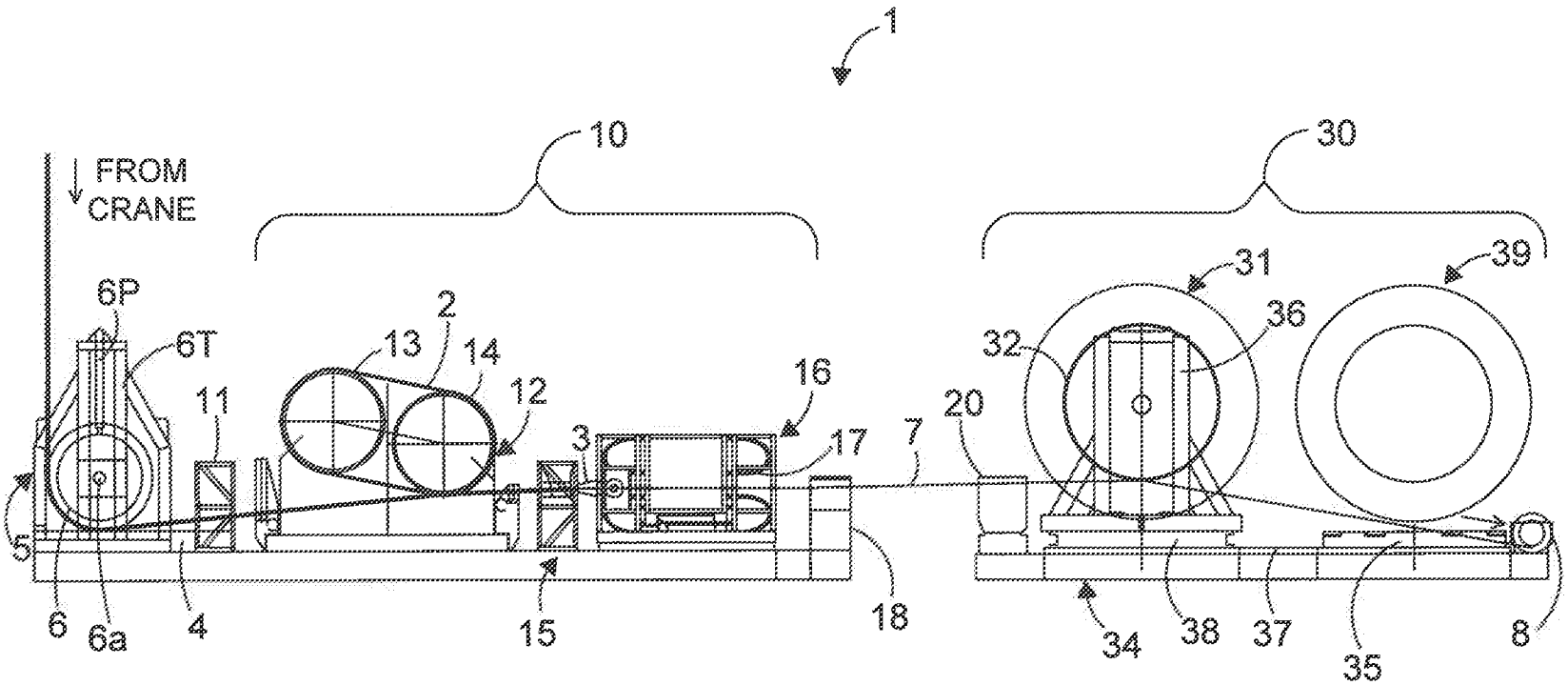
FIG. 7 shows the crane rope spooling system of FIG. 3 showing the next stage of the method on from the stage shown in FIG. 6, with the crane rope extending further into the crane rope maintenance system.
Figure 10:
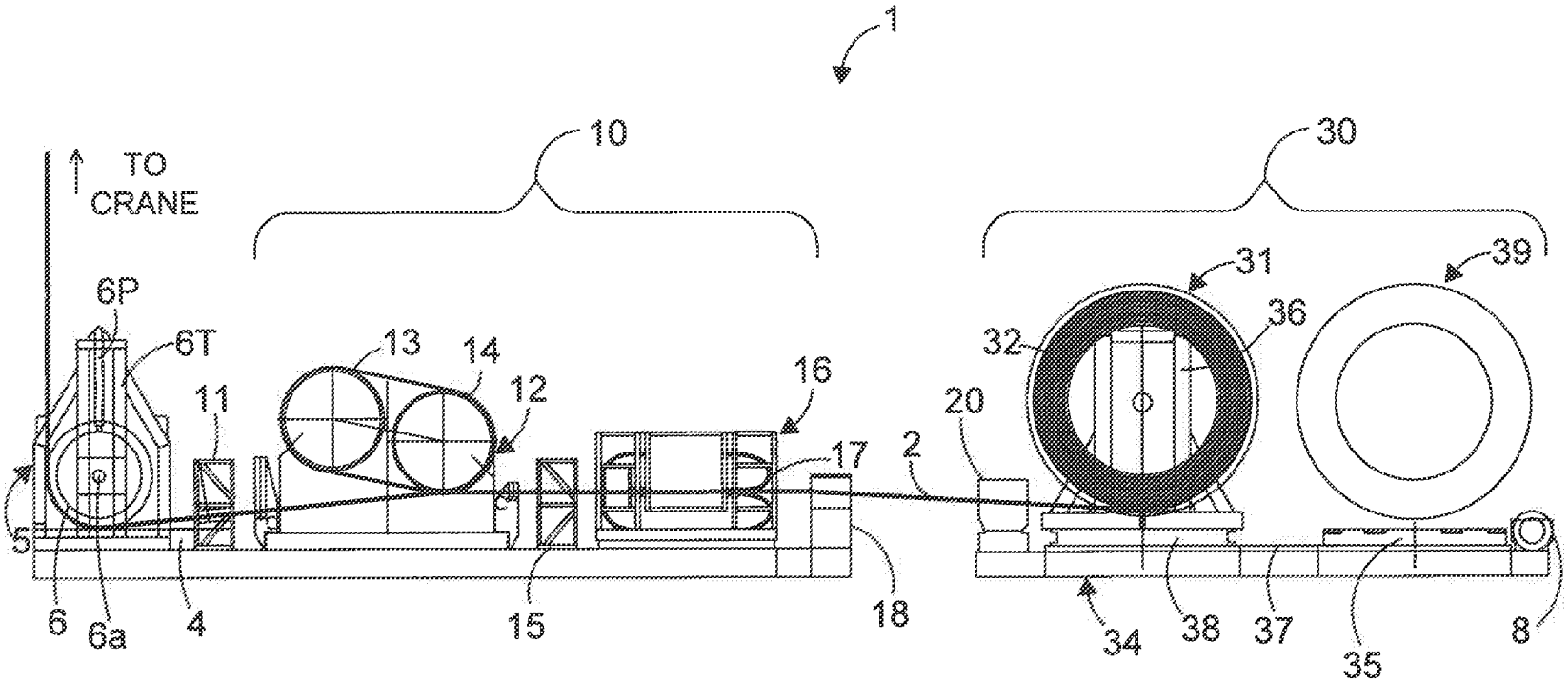
FIG. 10 shows the crane rope spooling system of FIG. 3 showing the next stage of the method on from the stage shown in FIG. 9, with the crane rope beginning to be returned to the crane (not shown)
Figure 11:
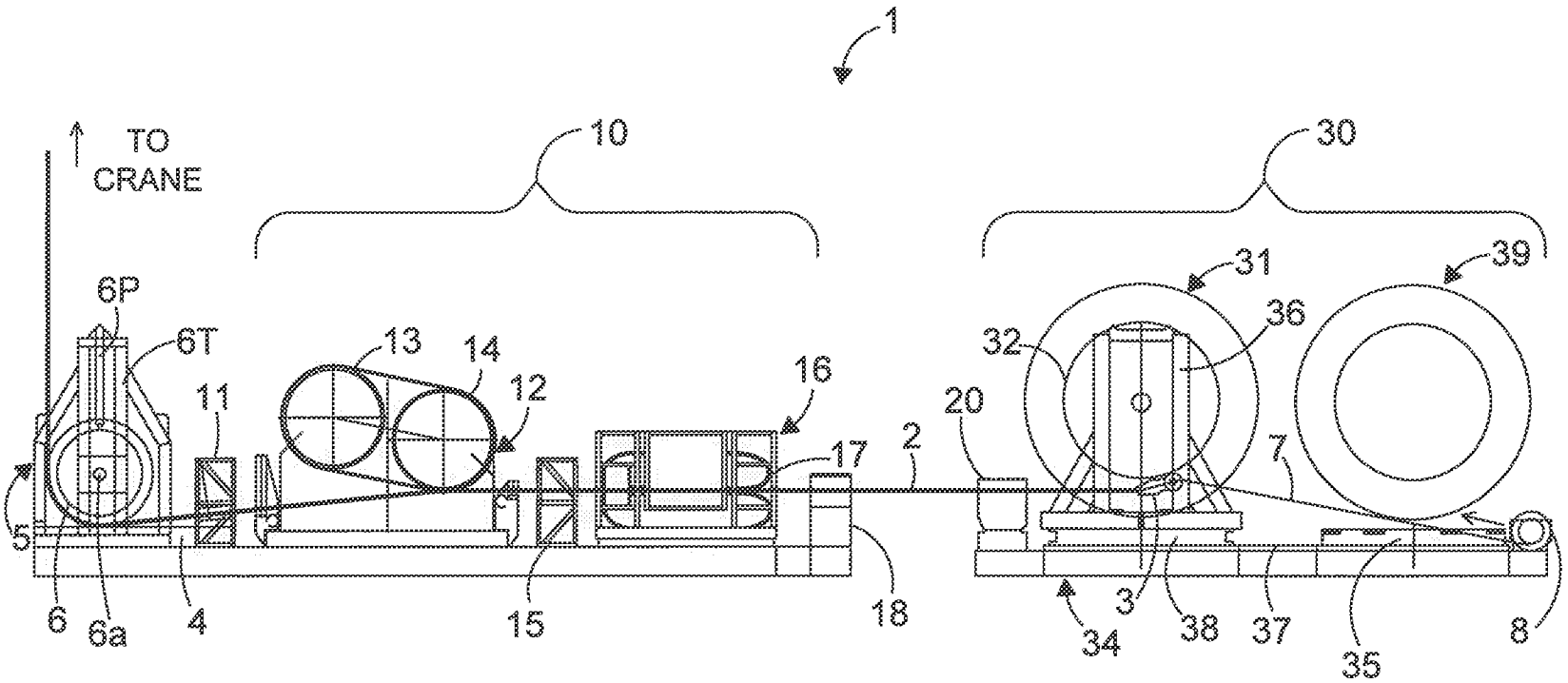
FIG. 11 shows the crane rope spooling system of FIG. 3 showing the next stage of the method on from the stage shown in FIG. 10, with the crane rope having been unspooled from the reel drive system and returning to the crane (not shown)
Figure 12:
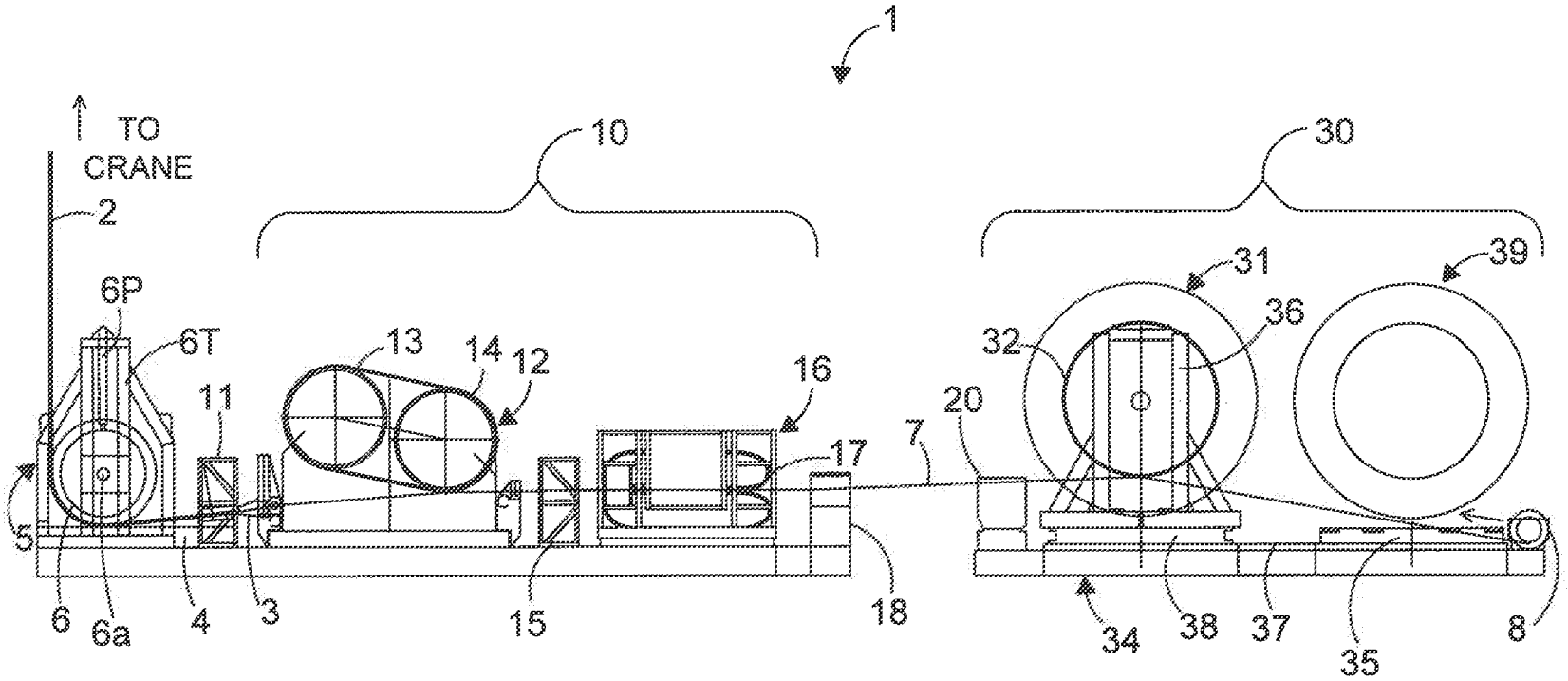
FIG. 12 shows the crane rope spooling system of FIG. 3 showing the next stage of the method on from the stage shown in FIG. 11, with the rope having been further reeled back towards the crane (not shown) and exiting the tensioning system.
Figure 13:
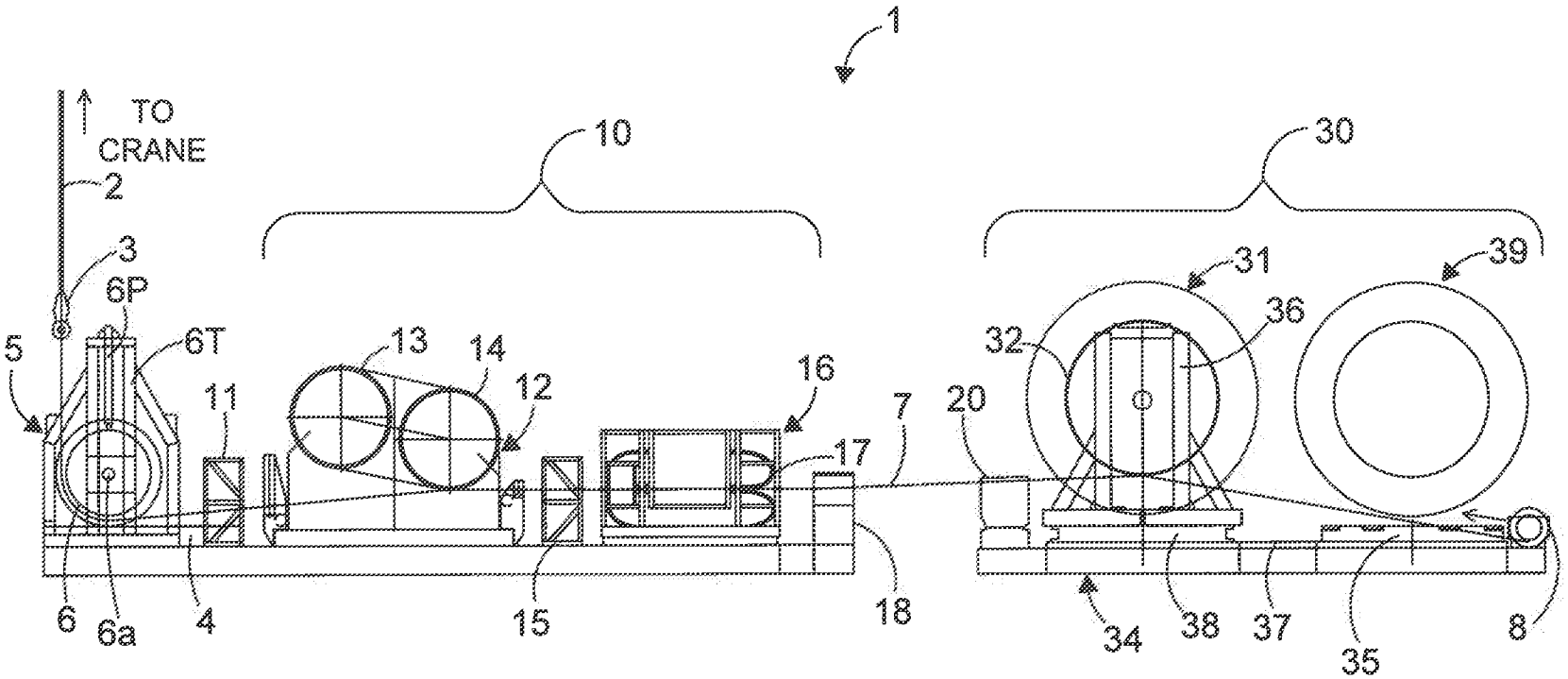
FIG. 13 shows the crane rope spooling system of FIG. 3 showing the next stage of the method on from the stage shown in FIG. 12, with the rope having been reeled back further towards the crane (not shown) and exiting the rope maintenance system.

After the rope 2 passes through the sheave assembly 5, as shown in FIG. 7, the rope 2 may then be passed through a grease injector 11. At this stage in the method, as the rope 2 is being reeled out from the crane drum, the grease injector 11 is not applying grease to the rope 2. However, the grease injector 11 can be activated at a later stage in the method to apply grease to the rope 2 after the testing process is complete, while the rope 2 is returning to the crane (e.g. during the later stage shown in FIGS. 10 to 12). When the grease injector 11 is activated, the grease lubricates the rope 2 and protects the rope 2 from both frictional damage and environmental damage.

Returning to FIGS. 6 and 7, after the rope 2 has passed through the grease injector 11 as it is being taken off the crane drum, it is then spooled around the twin drums 13, 14 of the traction winch 12. Each drum 13, 14 comprises two half circular shells that are put together to create the outer surfaces of the drums 13, 14. The shells have grooved surfaces formed on their outer surface (i.e. on their outer circumference) that can accommodate different diameters of rope 2. In order to accommodate different rope diameters, the shells can be taken off and replaced with shells having the appropriate size of grooves; for example one surface may comprise grooves that can accommodate rope with diameter 100-104 mm and another may accommodate a rope with diameter 120-125 mm. The ability to test and change out a variety of ropes with different diameters allows the same system 1 to be used for many different cranes and/or hoists which may have very different tonnage ratings, lifting capacities, and rope diameters. Additionally, the grooves in the surfaces of each drum 13, 14 of the traction winch 12 protect the rope 2 from being crushed against the surface of the drum 13, 14 in contrast to a capstan winch.

The drums 13, 14 of the traction winch 12 are offset from one another vertically so that the rope 2 is spooled onto the drums 13, 14 at an angle in a first direction. The grooves in the surfaces of the first drum 13 are offset from the grooves in the second drum 14, so that the rope 2 is wound around the surfaces of the drums 13, 14 at a second angle, relative to the mutual axis of the drums 13, 14. This negates a fleeting angle between the drums and reduces torque generation within the rope 2 as tension is applied to it throughout the maintenance process. The drums 13, 14 of the traction winch 12 are driven by a motor (not shown) to apply a pulling tension to the rope 2 and to hold it taut as it is fed into the tensioner 16. The traction winch 12 having two drums 13, 14 offers the advantage that the drums act to multiply the tension and force on the rope 2 in a similar fashion to a pulley sheave system.

As shown in FIGS. 3-13, a Non-Destructive Testing (NDT) inspection unit 15 is located between the traction winch 12 and the tensioner 16. The crane rope 2 passes through the NDT unit 15 as it is being transpooled on the reel drum 32 of the first reel 31 of the reel drive system 30 and is subject to non-destructive testing, for example using electromagnetic testing. However, any suitable non-destructing testing method may be used. The testing provides data regarding the integrity of the rope 2, which can then be rendered if desired, providing an operator with a visual output e.g. graphs illustrating any defects such as cracks, corrosion, etc. in the rope 2.

After the rope 2 passes through the traction winch 12 and the NDT inspection unit 15, the rope 2 then passes through the secondary back tensioner 16. In this example, the secondary back tensioner is a 2-track tensioner 16. The 2-track tensioner 16 grips the rope 2 between respective sets of pads such as polyurethane (PU) pads provided on each of its tracks 17, which cooperate to compress the rope 2 without deforming it. The frictional grip provided by the pads of the tracks 17 of the tensioner 16 acts to keep the rope 2 taut as it is being removed from the traction winch 12 (and before that the crane drum) so that the rope 2 is tightly laid onto the drum 32 of the reel 31. Preloading the rope 2 with tension using the traction winch 12 enhances the grip that the 2-track tensioner 16 can get on the rope 2 as it feeds through the tensioner 16 and moreover means that the rope 2 can be wound around the drum 32 with significantly higher tension loads than hitherto possible.

Preferably, one motor drives the twin drums of the traction winch 12 so that both drums of the traction winch 12 work together. Optionally the traction winch 12 is the master motor and the 2-track tensioner 16 is a slave; optionally an operator can set the amount of tension applied to the rope 2 by either or preferably both of the respective traction winch 12 and the 2-track tensioner 16. Optionally the 2-track tensioner 16 comprises at least one further motor. Optionally the 2-track tensioner 16 and the traction winch 12 work synchronously to prevent the rope 2 from sagging between the traction winch 12 and the 2-track tensioner 16. Loss of tension in the rope 2 can potentially lead to unwanted movement of the rope 2 within the NDT inspection unit 15, or problems with the data collected due to the rope 2 not being taut. For example, if the rope 2 was being transpooled onto the reel 31 and the 2-track tensioner 16 was moving the rope 2 more slowly than the traction winch 12, the delay between the rope exiting the traction winch 12 and entering the 2-track tensioner 16 could lead to the rope 2 becoming slack and inspection becoming less accurate and/or tension in the rope 2 is reduced. The motor(s) of the 2-track tensioner 16 and optionally the traction winch 12 offers resistance against the pulling force of the initiation winch 8 and, once the rope 2 has started to be spooled onto the reel 31, against the motor of the reel drive system 30. This resistance prevents the rope 2 moving freely within the system 1, for example sliding backwards or out of components of the maintenance system 1 and also imparts increased tension to the rope 2.

Optionally the reel drive system 30 determines the speed at which the rope 2 is spooled onto the reel 31. Optionally an operator can set the speed of the reel drive system 30. Optionally the reel drive system 30 drives the extraction of the rope 2 from the crane drum. Optionally the crane drum, together with the load applied on the rope by the traction winch 12, determines the speed at which the rope 2 is returned or transpooled onto the crane drum when the crane drum is rotated by its motor (not shown).

Preloading the rope 2 with tension from the traction winch 12 as it is being reeled off the crane drum is particularly useful when the rope 2 is coated in residual grease, as there is a potential risk of slippage of the rope 2 as it passes through the tensioning system 10 (and in particular through the tensioner 16), which may result in damage to the rope 2 and/or the rope 2 not spooling evenly onto the reel drum 32. The preloading of tension on the rope 2 by the traction winch 12 enhances the grip that the 2-track tensioner 16 gets on the rope 2, improving the laying-on of the rope 2 onto the reel drum 32, providing a compact layering of the rope 2 across and on the reel drum 32. Optionally the traction winch 12 and optionally the 2-track tensioner 16 each have a pre-set loading value, and/or optionally have a pre-set combined loading value.

Figure 8:
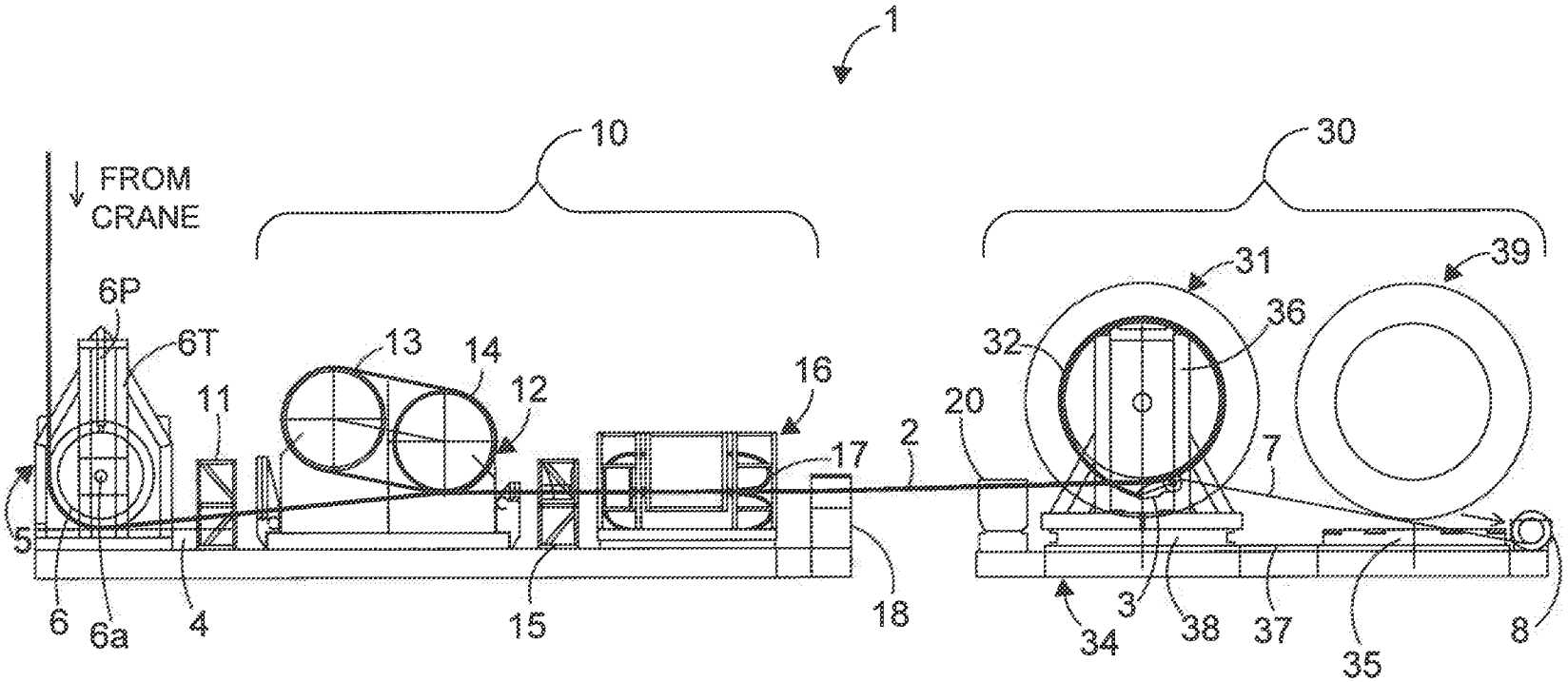
FIG. 8 shows the crane rope spooling system of FIG. 3 showing the next stage of the method on from the stage shown in FIG. 7, with the crane rope beginning to be laid onto the drum of the reel drive system.
Figure 9:
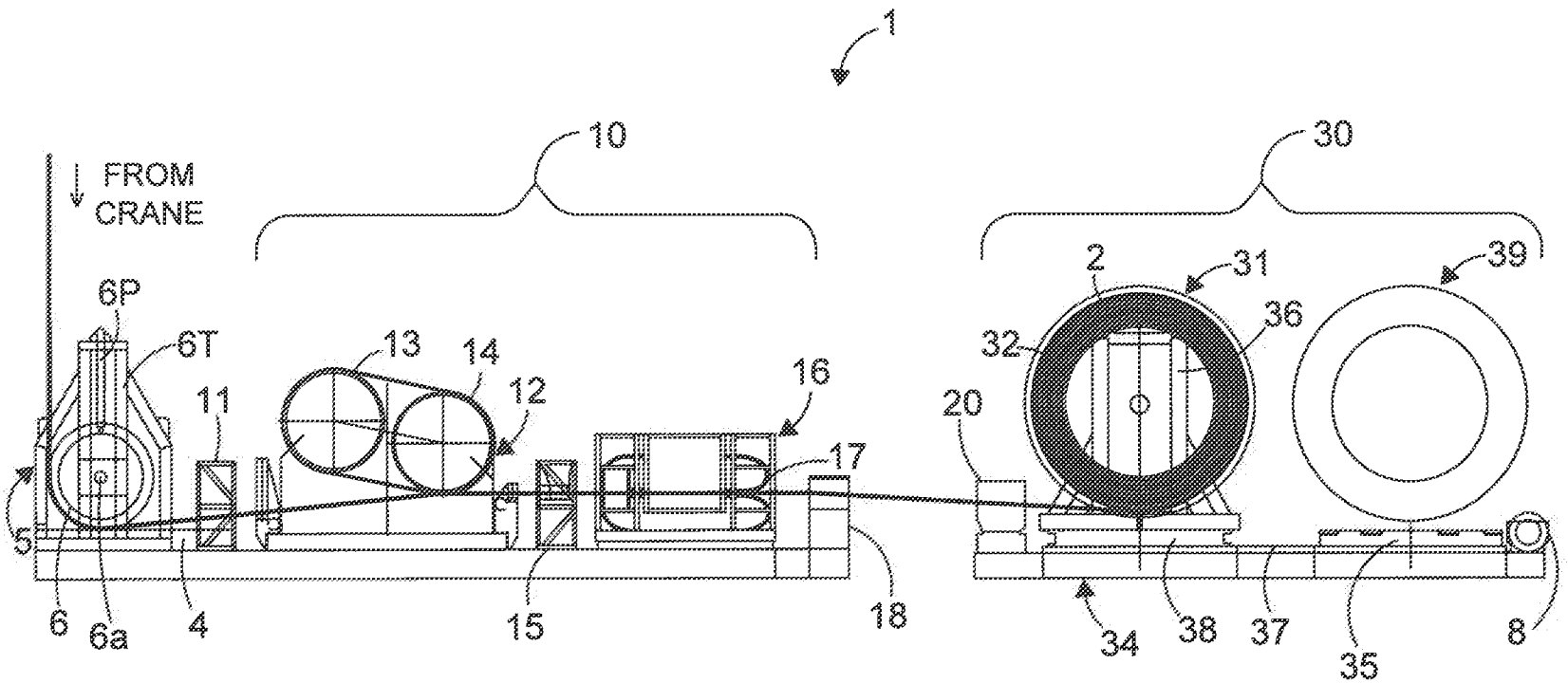
FIG. 9 shows the crane rope spooling system of FIG. 3 showing the next stage of the method on from the stage shown in FIG. 8, with the crane rope reaching it full extent spooled onto the reel drive system.

Adjacent to the 2-track tensioner 16, there is a wire guide 18 for keeping the rope 2 at the correct level and angle prior to feeding into the spooling unit 20, when the rope 2 is being removed from the crane and spooled onto the drum 32 of the reel drive system 30 as shown in FIG. 8.

The 2-track tensioner 16 preloads the rope 2 with tension as it is spooled onto the drum 32 of the reel 31. The tensioner 16 typically preloads the rope with 1 t-12 t (1,000 kg-12,000 kg), optionally 1 t-6 t (1,000 kg-6,000 kg) and preferably around 2 t-5 t (2,000 kg-5,000 kg) of tension as it is spooled onto the drum 32.

After the rope has passed through the tensioning system 10, it then passes through a spooling unit 20. The spooling unit 20 is positioned so that it is immediately adjacent to the reel drive system 30, in particular the first reel 31 of the reel drive system 30 as described in more detail below. The spooling unit 20 moves the rope 2 laterally, from side to side relative to the reel 31, as the rope 2 is spooled onto the drum 32 of the reel 31, thereby laying the rope 2 evenly across the drum 32.

The reel drive system 30 comprises a first empty reel 31, which receives the rope 2 that is undergoing testing as it is reeled out from the crane. The reel drive system 30 further comprises at least a second reel 39 with a new rope spooled onto it (not illustrated). Where the rope 2 undergoing testing is identified as requiring changing out, the new rope from the second reel 39 may be used to replace the old rope 2 that has undergone testing and requires changing out.

The reel drive system 30 comprises a skid system 34 that allows sliding movement of at least one tower 36 for connection to the reels 31, 39. The skid system comprises parallel rails 37 extending on either side of the reel drive system 30 and tower 36 which is configured to slide along the rails 37. The reel drive system 36 is connected to the "active" reel that is in current use, which in FIGS. 3-13 is the first reel 31. The reel drive system 34 is connected through the central axis of the reel 31 so that the reel 31 can rotate around the tower 36.

The tower 36 may comprise lifting apparatus (not illustrated). When the tower 36 is connected to a reel 31, 39, the lifting apparatus lifts the reel 31, 39 from the surface on which it is resting and thereby permits rotation of the reel 31, 39 around the tower 36.

The reels 31, 39 of the reel drive system 30 are each on pallets 35, 38 and thus can be easily lifted and repositioned, for example by a crane on vessel itself, or at the quayside or other onshore location when the reels 31, 39 are to be disposed of. Where, for example the crane rope 2 has been identified as defective and must be changed out, the rope 2 is completely removed from the crane so that the crane drum is empty and can receive a new replacement rope. The tower 36 is disconnected from the reel 31 and slid along the rails 37 to the second reel 39, which is holding new crane rope. The tower 36 is connected through the axis of the second reel 39 and the second reel 39 is then lifted from the pallet 38. Preferably, the pallets 35, 38 are seated on platforms (not shown), with the first platform holding the first pallet 35 at a higher level than the second platform holding the second pallet 38. This permits the new replacement rope to pass underneath the first reel 31 as it is payed out from the second reel 39.

The return of the rope 2 to the crane drum following testing by the NDT unit 15 is shown in FIGS. 10-13 and is substantially the same whether it is the old rope 2 being returned or a new rope being transpooled onto the crane drum. In this example, it is the same rope 2 being returned. As the rope 2 is being returned to the crane, it is payed out from the reel 31 and reeled in by the crane. The rope 2 passes through the spooling unit 20 and the wire guide 18, both of which guide the rope 2 from the reel 31 into the 2-track tensioner 16.

The 2-track tensioner 16 preloads the rope 2 and allows the traction winch 12 to generate much greater tension on the rope 2 as it is transpooled onto the crane drum. The 2-track tensioner 16 preferably preloads the rope 2 with a force within the range of 1 t-12 t (1,000 kg-12,000 kg), optionally 1 t-6 t (1,000 kg-6,000 kg), more preferably around 2-5 t (2,000 kg-5,000 kg) prior to the rope 2 being spooled onto the traction winch 12.

The traction winch 12 applies a predetermined back tension within the range of around 40 t-80 t (40,000 kg-80,000 kg), with the predetermined value being dependent/predetermined on the rope manufacturer's specifications. This leads to a total back tension on the rope 2 as it returns to the crane of about 20 t-100 t (20,000 kg-100,000 kg), preferably 40 t-80 t (40,000 kg-80,000 kg) in total, with the final value again being dependent on the manufacturer's specifications. In other words, the crane rope manufacturer specifies what total back tension the crane rope 2 should/must experience when wound onto the crane drum and the operator responsible for spooling the crane rope onto the crane drum will therefore take that manufacturer specified tension into account when setting the said predetermined tension figure. The tension that is applied to the rope 2 can be monitored and logged in real-time via a load cell (not shown) within the traction winch 12 as the rope 2 returns to the crane, which provides confirmation to users of the crane rope spooling system 1 that the rope 2 is being laid onto the crane drum tightly and in accordance with the manufacturer's specifications.

After the rope 2 passes through the traction winch 12 on its way back to the crane drum, it feeds through the grease injector 11, which applies a coating of lubricative and protective grease to the outside of the rope 2. This reduces frictional damage to the rope 2 as it is used and protects the wires and core of the rope 2 from the environment.

Finally the rope 2 passes through the sheave assembly 5 to turn approximately 90° and return to the crane in a substantially vertical orientation. The predetermined back tension that is applied to the rope 2 is experienced by the sheave assembly 5 as the rope turns around the wheel 6. The sheave assembly 5 is therefore weighted down by calibrated weights 4, which weigh around 60 t-80 t (60,000 kg-80,000 kg). The calibrated weights 4 are typically greater in weight than the maximum back tension applied to the rope 2 and which hold the sheave assembly 5 in place and resist the pulling and lifting effect of the back tension on the rope 2. The new rope can be loaded with the calibrated weights for additional back tension.

Modifications and improvements may be made to the examples hereinbefore described without departing from the scope of the invention.

The invention claimed is:

1. A method of spooling a crane rope onto a crane drum through a crane rope spooling system from a reel under a predetermined back tension, wherein the method includes the steps of:

unspooling the crane rope from a reel and passing the crane rope through a tensioning system comprising a primary back tensioner and a secondary back tensioner;

gripping the crane rope within the secondary back tensioner and thereby preloading the crane rope with tension prior to the crane rope passing through the primary back tensioner; and applying a predetermined back tension to the crane rope with the primary back tensioner as the crane rope is being spooled onto the crane drum under the predetermined back tension.

2. The method of claim 1, including monitoring and logging the tension on the crane rope at all times as it is being spooled onto the crane drum to assess the laying-on of the crane rope onto the crane drum.

3. The method of claim 1, including passing the crane rope through a greasing unit and thereby applying grease to the crane rope as it is being spooled onto the crane drum.

4. The method of claim 1, including connecting calibrated weights to a free end of the crane rope for load testing of the crane rope.

5. The method as claimed in claim 1, including configuring the primary back tensioner and the secondary back tensioner to provide resistance against the pulling force of the crane drum, and thereby maintain a defined load on the crane rope as it is spooled onto the crane drum.

6. The method as claimed in claim 1, including positioning the crane rope spooling system on a deck of a vessel and including compensating for heave of the vessel by using a heave compensation mechanism that is configured to move in response to movements of the vessel.

7. The method as claimed in claim 6, wherein the heave compensation mechanism is a movable wheel forming part of the sheave assembly and the method includes weighting down the sheave assembly to prevent lifting of the sheave assembly as the crane rope is spooled on to the crane drum under the predetermined back tension.

8. The method as claimed in claim 1, including the prior steps of unspooling the crane rope from the crane drum, passing the crane rope through the crane rope spooling system, and spooling the crane rope onto a reel drum within a reel drive system.

9. The method as claimed in claim 8, wherein the method includes the prior step of connecting a free end of the crane rope to a cable that is reeled out from an initiation winch, including the further step of pulling the crane rope into the crane rope spooling system by reeling the cable back around the initiation winch and thereby guiding the crane rope into the crane rope spooling system and further including applying a constant tension to the crane rope after it has been pulled into the crane rope spooling system by the initiation winch.

10. The method as claimed in claim 8, including passing the crane rope through a spooling unit before the crane rope is spooled onto the reel within the reel drive system, wherein the spooling unit moves laterally in a repeated motion to evenly lay the crane rope onto the reel drum.

11. The method of claim 8 further including mounting the reel drive system on tracks along which the reel drive system is configured to skid; disconnecting the reel drive system from the reel when the reel is no longer required; skidding the reel drive system between reels; and reconnecting the reel drive system to a new reel to be utilized.

12. The method as claimed in claim 9, including configuring the primary back tensioner and the secondary back tensioner to provide resistance against the pulling force of the initiation winch and thereby maintain the tautness of the crane rope.

13. The method as claimed in claim 12, wherein the method includes tensioning the crane rope as it is removed from the crane drum and applying back tension to the crane rope as it is laid onto the reel within the reel drive system and including preloading the crane rope with tension applied by the secondary back tensioner as the crane rope is spooled onto the reel within the reel drive system.

14. The method as claimed in claim 1, including testing the crane rope using non-destructive testing methods after the crane rope passes through at least part of the tensioning system.

15. The method of claim 14, including changing out the crane rope in response to detection of a defect during testing of the crane rope.

16. A crane rope spooling system for spooling crane rope onto a crane drum under a predetermined back tension, said system comprising a tensioning system comprising at least a primary back tensioner and a secondary back tensioner and a reel.

17. A crane rope spooling system as claimed in claim 16, wherein as crane rope is being spooled on to the crane drum, the secondary back tensioner preloads the crane rope and allows the primary back tensioner to generate a predetermined back tension on the crane rope.

18. A crane rope spooling system as claimed in claim 16, wherein the tensioning system applies back tension to the rope of 20 t-100 t.

19. A crane rope spooling system as claimed in claim 16, wherein the crane rope spooling system comprises monitoring and logging means configured to monitor and log the tension on the crane rope at all times as the crane rope is being spooled onto the crane drum.

20. A crane rope spooling system as claimed in claim 16, wherein the primary back tensioner is a traction winch and wherein the traction winch comprises two drums around which the crane rope is spooled, wherein the drums are adapted to be turned by a motor.

21. A crane rope spooling system as claimed in claim 16, wherein a surface of the primary back tensioner comprises grooves, wherein the grooves are offset or angled such that the crane rope is wound around the primary back tensioner at an angle relative to the axis of the primary back tensioner.

22. A crane rope spooling system as claimed in claim 16, wherein the secondary back tensioner is a 2-track tensioner.

23. A crane rope spooling system as claimed in claim 16, wherein the crane rope spooling system further comprises a grease injector, wherein the grease injector is configured to apply grease to the crane rope.

24. A crane rope spooling system as claimed in claim 16, wherein the crane rope spooling system further comprises a wire guide, wherein the wire guide is adapted to maintain the crane rope at the correct level and angle prior to feeding the crane rope into the secondary back tensioner when the crane rope is being spooled on to the crane drum.

25. A crane rope spooling system as claimed in claim 16, wherein the crane rope spooling system includes an initiation winch located adjacent to the reel, wherein the reel is within a reel drive system; wherein the initiation winch comprises a cable, wherein the cable is connected to a free end of the crane rope on a crane drum.

26. A crane rope spooling system as claimed in claim 16, wherein the crane rope spooling system is further suitable for removing a crane rope from a crane drum and passing the crane rope through the crane rope spooling system.

27. A crane rope spooling system as claimed in claim 26, wherein as the crane rope is being reeled off the crane drum, the crane rope passes through the primary back tensioner prior to passing through the secondary back tensioner; and wherein the crane rope is preloaded with tension by the primary back tensioner before it enters the secondary back tensioner, thereby enhancing the grip of the secondary back tensioner on the crane rope as it feeds through the secondary back tensioner.

28. A crane rope spooling system as claimed in claim 26, further comprising a non-destructive testing unit for testing the crane rope as it is being removed from the crane drum by passing the crane rope through the non-destructive testing unit.

29. A crane rope spooling system as claimed in claim 26, wherein a spooling unit moves laterally as the crane rope is spooled onto the reel within a reel drive system, thereby laying the crane rope evenly across the reel.

30. A crane rope spooling system as claimed in claim 26, further comprising a reel drive system, wherein the reel drive system comprises an empty reel within the reel drive system, onto which the crane rope undergoing testing is spooled.

31. A crane rope spooling system as claimed in claim 27, wherein the secondary back tensioner preloads the crane rope with tension as it is spooled onto the reel within a reel drive system.

32. A crane rope spooling system as claimed in 10, wherein the reel drive system comprises a reel with a new crane rope spooled onto it.

33. A crane rope spooling system as claimed in claim 30, wherein the reel drive system comprises parallel tracks, wherein the reel drive system is configured to skid along said tracks between the crane rope spooling system reel and the reel within the reel drive system and wherein the reel drive system is connected to an active reel, wherein the active reel is the reel on which rope currently in use is spooled.

34. A crane rope spooling system as claimed in claim 16, wherein the crane rope spooling system further comprises a sheave assembly, wherein the sheave assembly comprises a wheel, and wherein the wheel of the sheave assembly is adapted to turn the crane rope and thereby ensure that the crane rope is entering the tensioning system at the correct angle.

35. A crane rope spooling system as claimed in claim 16, wherein the crane rope spooling system further comprises an initiation winch, the initiation winch comprising a winch cable, and wherein when the crane rope is to be removed from the crane drum and passed through the crane rope spooling system, the winch cable is connected to a free end of the crane rope, the initiation winch is turned, and the initiation winch cable is reeled back onto the initiation winch drum; and wherein as the initiation winch cable is reeled in, the crane rope is extracted from the crane drum and pulled into the crane rope spooling system.

36. A crane rope spooling system as claimed in claim 16, wherein the crane rope passes through a sheave assembly and wherein the sheave assembly comprises a wheel, wherein the wheel is configured to turn the crane rope and thereby ensure that the crane rope is exiting the tensioning system at the correct angle.

37. A crane rope spooling system as claimed in claim 36, wherein the sheave assembly comprises a heave compensation mechanism, wherein the wheel of the sheave assembly is configured to move in response to heave experienced by a vessel on which the crane rope spooling system is located.

* * * * *